US006625825B1

(12) United States Patent
Groner et al.

(10) Patent No.: US 6,625,825 B1
(45) Date of Patent: Sep. 30, 2003

(54) CONVERTIBLE SHOWER

(75) Inventors: David M. Groner, Oil City, PA (US); Richard W. Schmader, Shippenville, PA (US); Brian Milford, Venus, PA (US)

(73) Assignee: GFM, Inc., Shippenville, PA (US)

( * ) Notice: Subject to any disclaimer, the term of this patent is extended or adjusted under 35 U.S.C. 154(b) by 42 days.

(21) Appl. No.: 09/678,970

(22) Filed: Oct. 4, 2000

(51) Int. Cl.[7] ..... A47K 3/22
(52) U.S. Cl. ..... 4/597; 4/584; 4/614
(58) Field of Search ..... 4/584, 592, 514, 4/539, 612, 613, 614, 600, 599, 596, 597

(56) References Cited

U.S. PATENT DOCUMENTS

| | | | | | |
|---|---|---|---|---|---|
| 1,749,275 | A | * | 3/1930 | Cromwell | 4/614 |
| 1,844,988 | A | * | 2/1932 | Steinkamp | 4/590 |
| 2,427,375 | A | * | 9/1947 | Walker et al. | 4/584 |
| 2,508,969 | A | * | 5/1950 | Richardson | 4/552 |
| 3,096,526 | A | * | 7/1963 | Vecenie | 4/590 |
| 3,098,240 | A | * | 7/1963 | Fleenor | 4/576.1 |
| 3,827,086 | A | * | 8/1974 | Seymour et al. | 52/35 |
| 4,299,064 | A | * | 11/1981 | Daniels | 4/580 |
| 4,337,540 | A | * | 7/1982 | Lindeman | 4/546 |
| 4,457,031 | A | | 7/1984 | Moore | 4/614 |
| 4,578,832 | A | * | 4/1986 | Primucci | 4/614 |
| 4,970,734 | A | * | 11/1990 | Friedman et al. | 4/597 |
| 4,987,619 | A | * | 1/1991 | Smith | 4/612 |
| 5,381,831 | A | * | 1/1995 | Versland | 137/868 |
| 5,383,240 | A | * | 1/1995 | Weeks, Sr. | 4/584 |
| 5,778,463 | A | * | 7/1998 | Teckchandani et al. | 4/538 |
| 5,960,489 | A | * | 10/1999 | Hanel et al. | 4/538 |
| 6,226,808 | B1 | * | 5/2001 | Walshe | 4/552 |

FOREIGN PATENT DOCUMENTS

| | | | | |
|---|---|---|---|---|
| DE | 3832334 A1 | * | 4/1990 | 4/584 |
| DE | 0415058 A2 | * | 3/1991 | 4/612 |
| WO | WO 93/23236 | * | 11/1993 | 4/584 |

* cited by examiner

*Primary Examiner*—Gregory Huson
*Assistant Examiner*—Huyen Le
(74) *Attorney, Agent, or Firm*—Webb Ziesenheim Logsdon Orkin & Hanson, P.C.

(57) ABSTRACT

A shower stall configured to receive a removable bathing tub such that the shower stall does not have to be modified when the removable bathing tub is installed or removed, wherein the shower stall is easily converted from a shower stall and bathing tub combination to a shower stall standing alone.

17 Claims, 8 Drawing Sheets

CONVERTIBLE SHOWER

BACKGROUND OF THE INVENTION

1. Field of the Invention

The present invention relates to bathroom fixtures and, more particularly, to a shower stall configured to receive a removable bathing tub.

2. Brief Description of the Prior Art

Shower stalls typically include at least one wall and, generally, a planar floor having a shower drain wherein the wall and the floor define a shower cavity and an ingress and egress opening. A door, such as a pivotable door or a curtain, usually is provided across the ingress and egress opening to allow easy entry into the shower cavity and to create a privacy barrier. A water-dispensing head and a spigot is usually positioned adjacent to the at least one wall, wherein water flow to the water-dispensing head is controlled by the spigot. In operation, water flows through the spigot to the water-dispensing head, through the water-dispensing head into the shower cavity, and finally is received in the shower drain, along with soap, shampoo, and dirt.

Because shower stalls typically are not designed to retain a specified volume of water, the floor portion of the shower is usually only slightly recessed into a floor of the bathroom or raised slightly with respect to the bathroom floor. The inherent design of shower stalls is particularly advantageous in applications where enhanced access to the shower stall is desired, such as in those cases where a person is physically challenged. As a result, the typical shower stall design generally is not designed to provide for a partial submersion bath.

Because some people prefer to draw and temporarily retain a desired volume of water for a partial submersion bath, as well as shower, shower stalls are often combined with bathing tubs to form a shower stall and bathing tub combination bathing fixture. Bathing tubs generally include a tub body forming a bathing recess, wherein the bathing recess is configured for receiving and temporarily retaining water. The bathing tub is positioned on a bathroom floor and the shower stall is erected around the bathing tub. Water is then either drawn into the bathing recess for a submersion bath or routed to the water-dispensing head and dispensed into the shower cavity. However, because bathing tubs typically have at least one side wall extending in a direction substantially perpendicular to the bathroom floor across the ingress and egress opening, the accessibility advantages of the shower stall standing alone are effectively eliminated.

Because a shower stall and bathing tub combination is versatile, and because of the vast number of people who do not require enhanced access to a bathing fixture, many residential and leasehold structures are equipped with shower stall and bathing tub combination bathing fixtures. However, if the need for enhanced accessibility does arise, which is an ever increasing proposition as life expectancies increase, it is often an expensive and time-consuming proposition to convert a shower stall and bathing tub into a just a shower stall. Moreover, once the need for enhanced access ends, it is also expensive to convert a shower stall back into the preferred shower stall and bathing tub configuration.

SUMMARY OF THE INVENTION

It is therefore an object of the present invention to provide a versatile bathing fixture having a shower stall configured to receive a removable bathing tub.

In one embodiment, the shower stall generally includes at least one wall and a floor portion, with the at least one wall and the floor portion defining a shower cavity. The floor portion further defines a shower drain configured to be connected to a wastewater conduit.

The removable bathing tub generally includes a tub body forming a bathing recess for receiving and holding water, a tub drain configured to be fluidly connected to the shower drain defined by the floor portion of the shower stall, an overflow orifice fluidly connected to the tub drain, the bathing recess, and a riser orifice.

When the need for enhanced accessibility is required, the shower stall stands alone, without the bathing tub. However, once the need for enhanced accessibility has ended, such as when a tenant vacates an apartment, the bathing tub can be fitted into the shower cavity. The conversion generally includes the steps of:

a. providing a watertight seal between the shower drain and the tub drain;

b. inserting the bathing tub into the shower cavity; and c. caulking seams formed at intersections of the wall of the shower stall and the tub body.

Additional steps for reverting to the shower stall alone include:

d. removing caulk;

e. removing the bathing tub from the shower cavity; and f. removing the watertight seal between the shower drain and the tub drain.

One important feature of the present invention is the ability to provide a bathing fixture configured to mirror the life cycle of an individual while simultaneously obviating the need for substantial remodeling or renovation. For example, when the child is young, the bathing tub allows a caregiver to bathe the child in a shallow bath. As the child grows older, and can bathe without assistance, the child has the choice of showering or drawing a bath. However, if the child should subsequently become physically challenged, either during childhood or much later in life, the bathing tub can be easily removed to provide enhanced access to the shower stall. Once the need for enhanced access to the shower stall passes, the bathing tub can be reinstalled according to the needs of a new user, without substantially disrupting plumbing or other objects surrounding the shower stall.

These and other advantages of the present invention will be clarified in the description of the preferred embodiments taken together with the attached drawings in which like reference numerals represent like elements throughout.

DETAILED DESCRIPTION OF THE PREFERRED EMBODIMENT

FIGS. 1–4 show a bathing fixture 10 according to the present invention having a shower stall 12 and removable bathing tub 14. However, in the interest of clarity, the shower stall 12 shown in FIGS. 5–7 and the bathing tub 14 shown in FIG. 8 will be discussed individually before the bathing fixture 10 combination shown in FIGS. 1–4.

Figure 5:
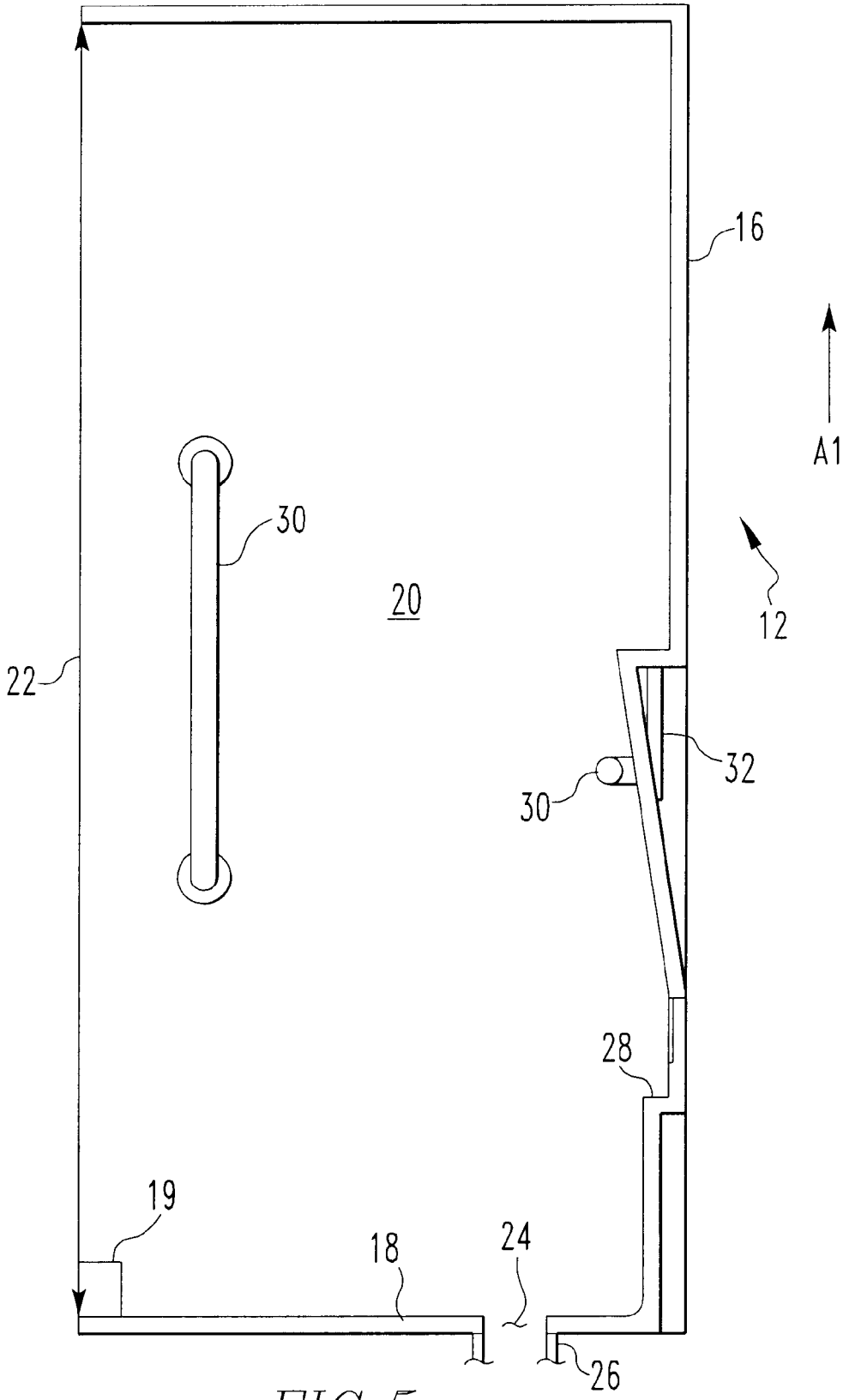
FIG. 5 is a sectional end view of the shower stall shown in FIGS. 1–4 with the bathing tub removed.
Figure 6:
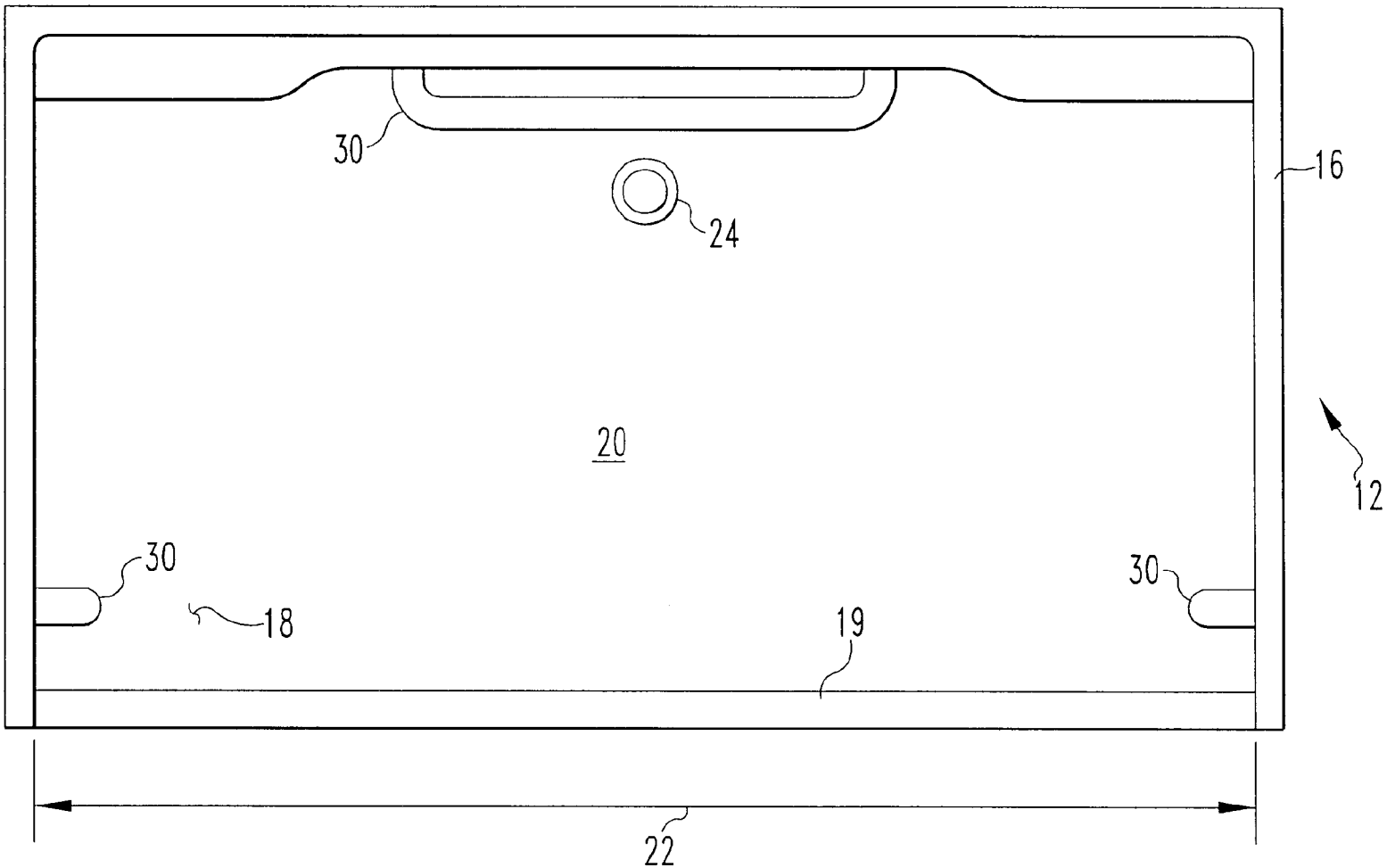
FIG. 6 is a top view of the shower stall shown in FIG. 5.
Figure 7:
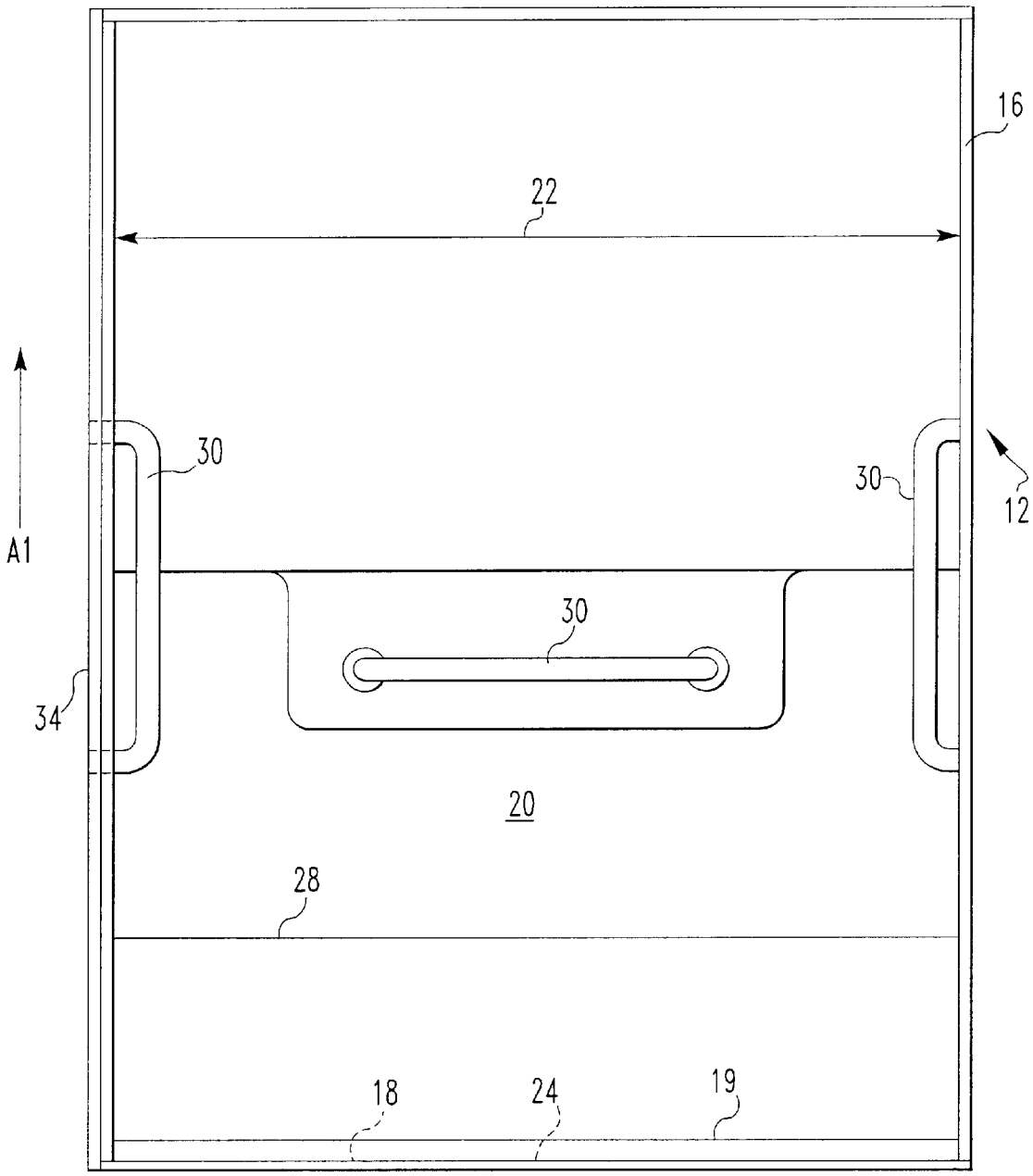
FIG. 7 is a side view of the shower stall shown in FIGS. 5 and 6.

A shower stall assembly 12 according to one embodiment of the present invention is shown in FIGS. 5–7. As shown in FIGS. 5 and 6, the shower stall assembly 12 generally includes at least one wall 16. It will be evident to one skilled in the art that commercially available shower stall assemblies, such as those provided by Clarion Bathware, assignee of the present invention, typically are a single wall of acrylic, fiberglass, or other suitable material, pre-formed into a specified shape or two or more walls which are connected to one another to form a desired shape. Therefore, both of these configurations are clearly contemplated. Moreover, the at least one wall 16 can be a wall or a series of connected walls which are clad in ceramic or other types of tile or wall coverings. La general, because the shower stall assembly is in contact with water, the shower stall assembly is made from a waterproof or water-resistant material, such as the acrylic, fiberglass, or ceramic tile materials discussed above, or any other suitable material known to those skilled in the art.

The at least one wall 16 rises in a direction Al (FIGS. 5 and 7) away from a floor portion 18 of the shower stall 12. The floor portion 18 can be integrally formed with the at least one wall 16. The at least one wall 16 and the floor portion 18 define a shower cavity 20 and an ingress and egress opening 22. The floor portion 18 further defines a removable riser 19 to help prevent water leakage and a shower drain 24 configured to be connected to a wastewater conduit 26, shown in FIG. 5. A shower stall door (not shown) may also be positioned across the ingress and egress opening 22 shown in FIGS. 5–7 to provide privacy and to help prevent water from exiting the shower stall 12.

As shown in FIGS. 5 and 7, the at least one wall 16 preferably forms an alignment ridge 28 (discussed later). As previously discussed above, the at least one wall 16 is preferably formed from acrylic, fiberglass, or other suitable materials. Grab handles 30 are preferably secured to the at least one wall 16 by a reinforcing member 32 and are made from stainless steel, aluminum, or other suitable material as shown in FIG. 5, integrally formed with the at least one wall 16 as shown in FIG. 6, or mounted into a wall stud 34 as shown in FIG. 7.

Figure 8:
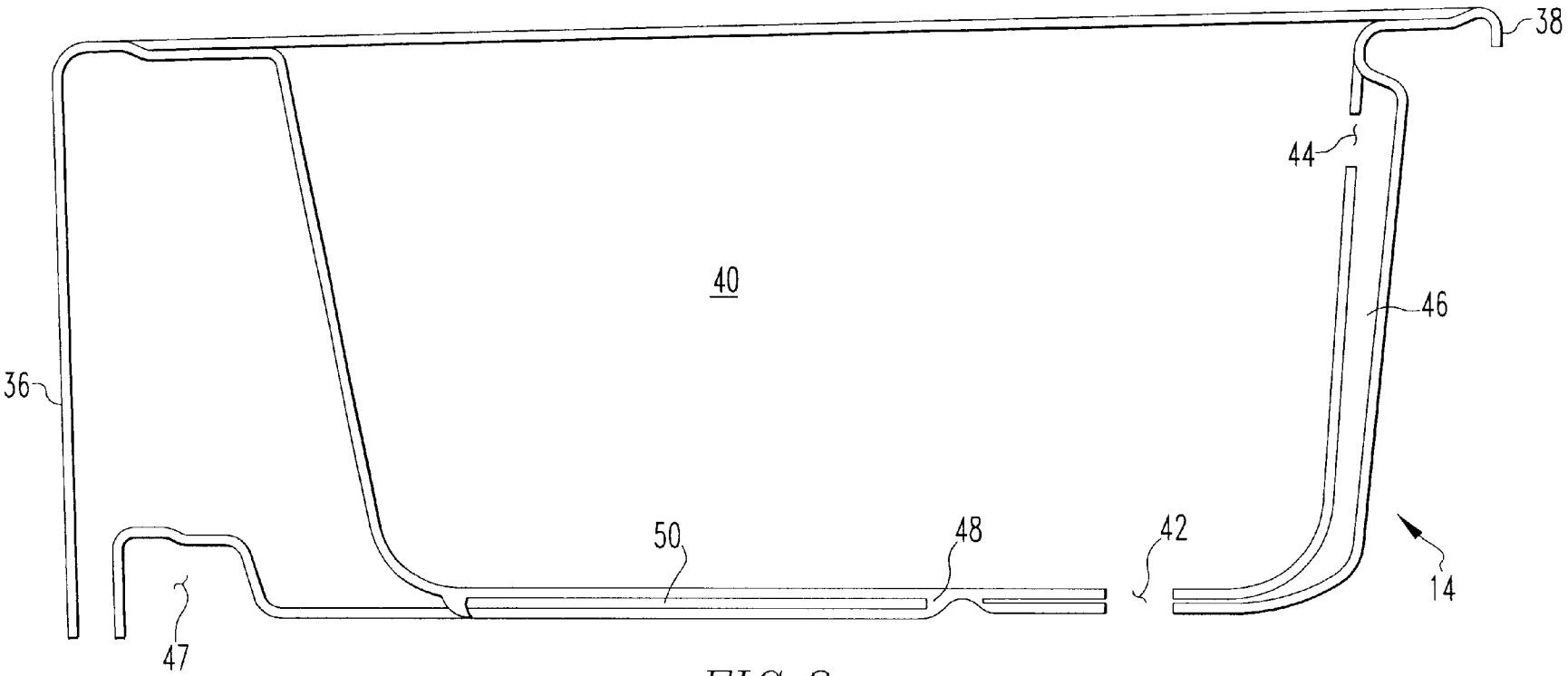
FIG. 8 is a sectional end view of the removable tub shown in FIGS. 1–4.

The removable bathing tub 14, shown in detail in FIG. 8, generally includes a tub body 36 defining an alignment edge 38, a bathing recess 40 for receiving and temporarily holding water, a tub drain 42, an overflow orifice 44 fluidly connected to the tub drain 42 via an overflow conduit 46, and a riser receiving orifice 47. The tub body 36 is preferably a one piece design constructed from acrylic, fiberglass, or other suitable material and is preferably removable as a single unit. A base portion 48 of the bathing tub 14 also preferably includes a reinforcing plate 50 made from wood, such as balsa wood, or from another suitable material capable of providing reinforcement to the base portion 48 of the bathing tub 14. In general, because the bathing tub is in contact with water, the bathing tub is made from a waterproof or water-resistant material, such as the acrylic, fiberglass, or ceramic tile materials discussed above, or any other suitable material known to those skilled in the art. Moreover, the bathing tub should be sturdy enough to be self-standing and strong enough to withstand the combined weight of a bather and bath water.

Figure 1:
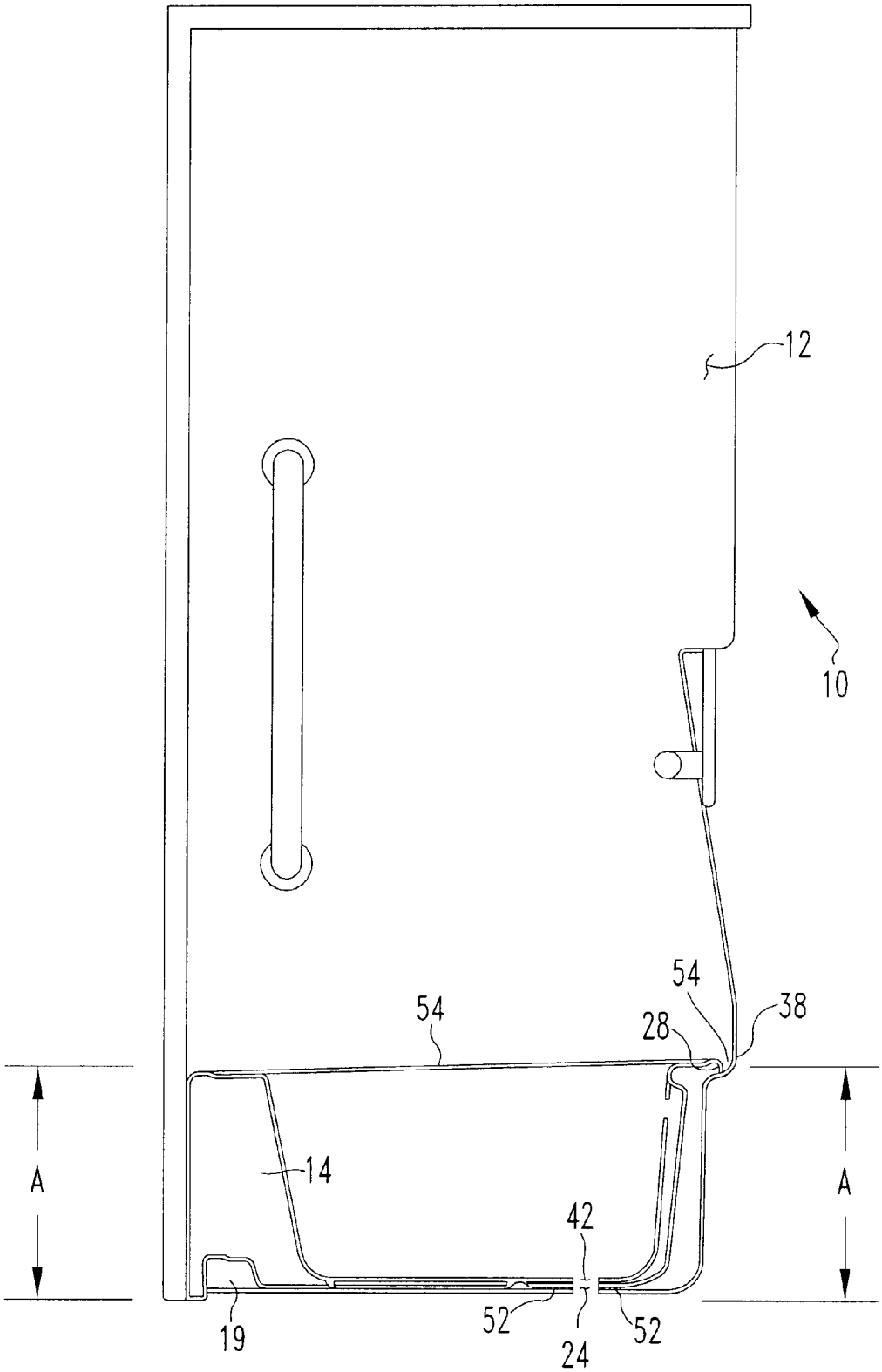
FIG. 1 is a sectional end view of a shower stall and bathing tub according to one embodiment of the present invention.
Figure 2:
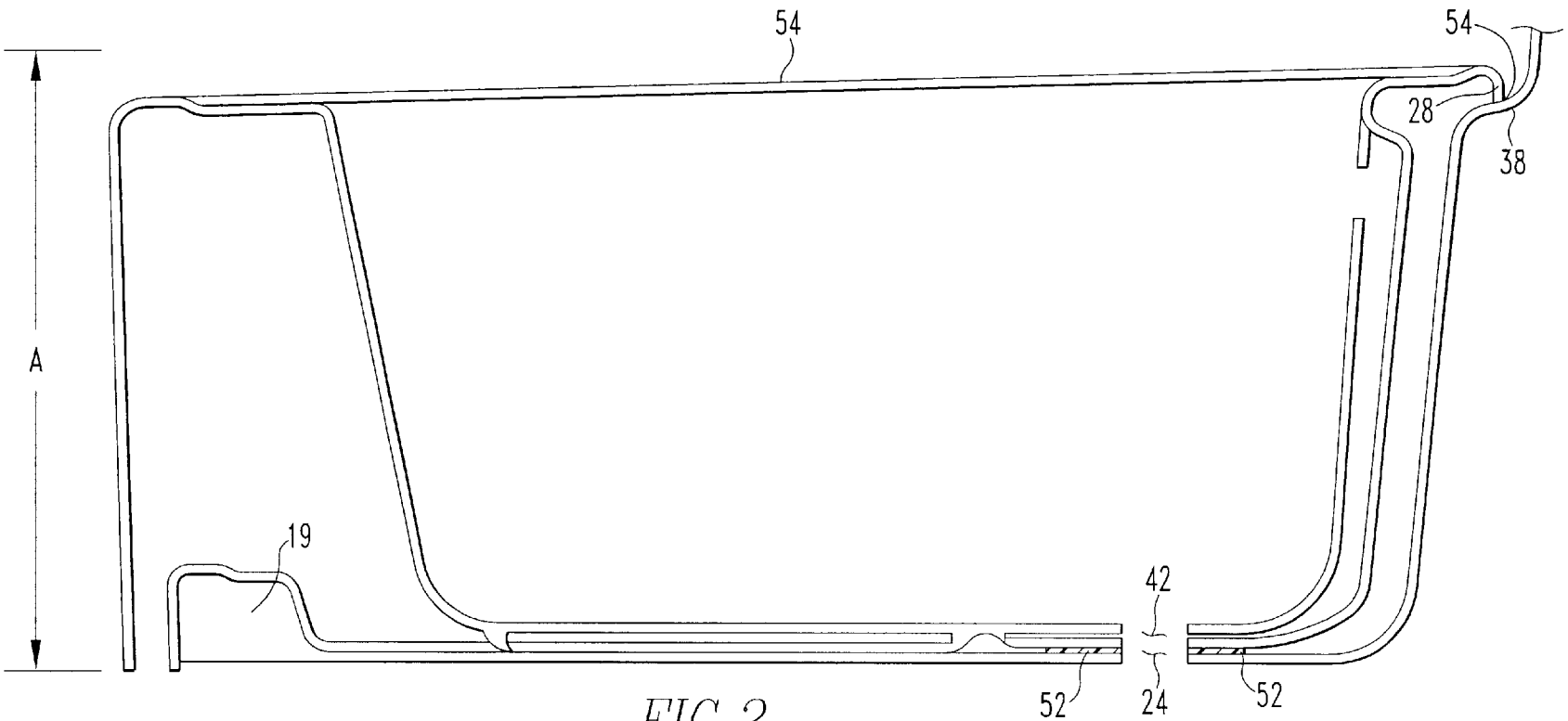
FIG. 2 is a sectional end view of a portion of the shower stall and bathing tub shown in FIG. 1.

FIGS. 1–4 show the bathing tub 14 removably installed in the shower stall 12. FIGS. 1 and 2 show the alignment edge 38 of the bathing tub 14 positioned adjacent to the alignment ridge 28 formed by the at least one wall 16 of the shower stall 12. The tub drain 42 is preferably aligned with the shower drain 24, with a sealing member 52 positioned between the shower drain 24 and the tub drain 42 to provide a watertight seal and to prevent water leakage between the bathing tub 14 and the floor portion 18 of the shower stall 12. The sealing member 52 is preferable an O-ring made from rubber. However, an O-ring made from wax, plumbers putty, caulk, or other suitable material clearly is contemplated. Moreover, a hollow conduit or other suitable sealing member 52 may also be used. The riser 19 is fitted into the riser receiving orifice 47 of the tub body 36.

Figure 3:
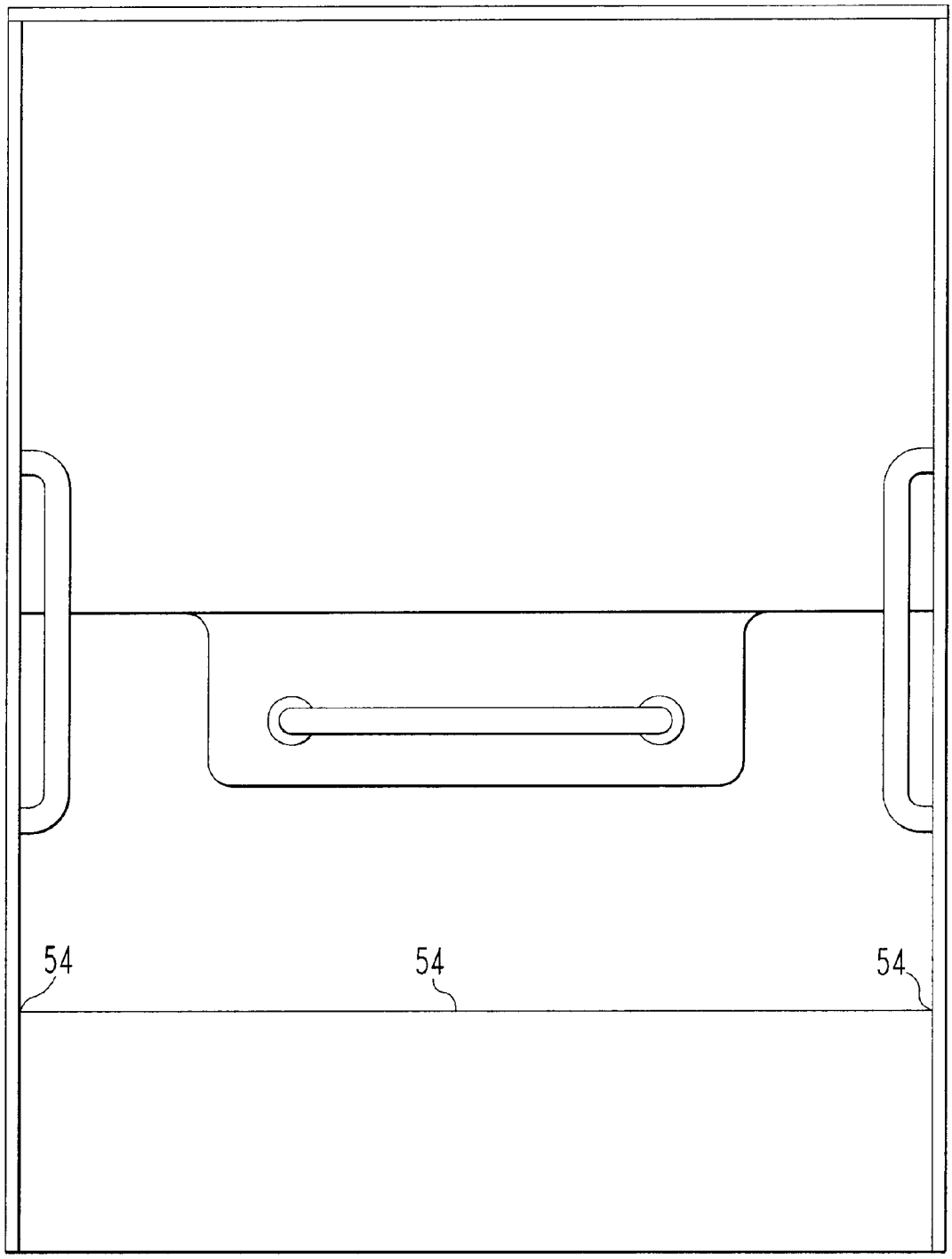
FIG. 3 is a side view of the shower stall and bathing tub shown in FIG. 1.
Figure 4:
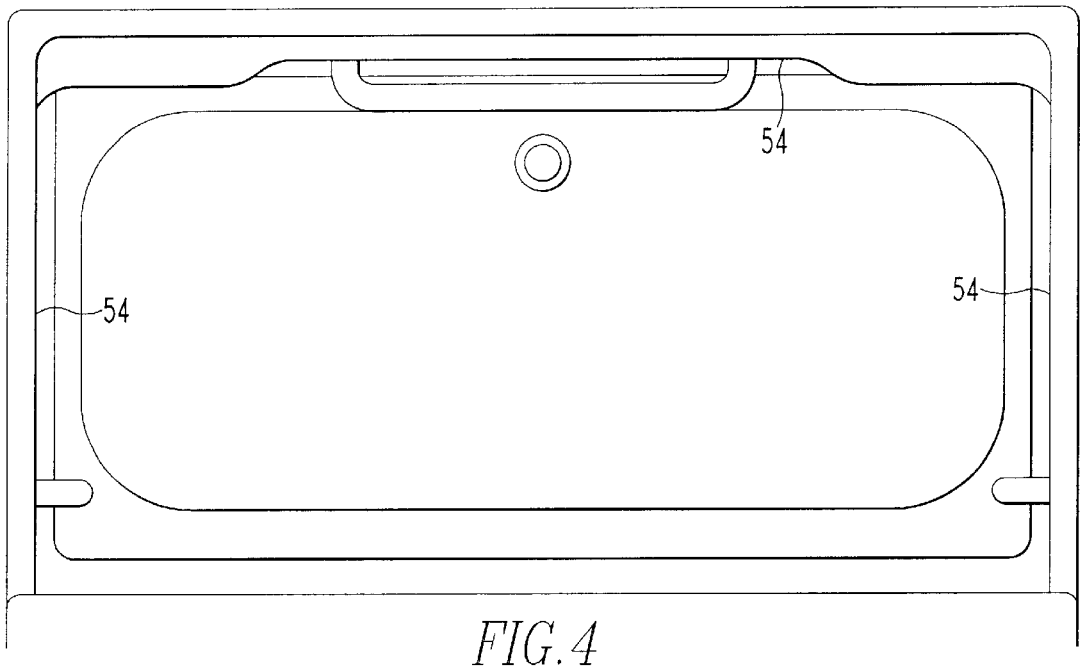
FIG. 4 is a plan view of the shower stall and bathing tub shown in FIGS. 1–3.

As shown in FIGS. 3 and 4, seams 54 formed by the intersection of the alignment edge 38 and the alignment ridge 28, as well as at other intersections of the at least one wall 16 and the bathing tub 14, are preferably caulked in a conventional manner to prevent water from seeping into the seams 54.

With the bathing tub 14 installed in the shower stall 12, the resulting bathing fixture 10 can be used for baths or showers. When the need for enhanced accessibility to the bathing fixture 10 is required, the bathing tub 14 and the sealing member 52 are removed from the shower stall 12. Caulking at the seams 54 can be removed with petroleum distillate (naphtha).

The present invention therefore provides a versatile bathing fixture that can accommodate the particular preferences of an individual. If a shower stall is desired, without a bathing tub, the present invention can be installed without the bathing tub. If a bathing tub is subsequently needed, the shower stall is configured to receive a removable tub, without removing the shower stall. Once installed, the bathing tub can be subsequently removed, without significantly disturbing the shower stall.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. A bathing fixture comprising:

a shower stall assembly substantially made from a material selected from the group comprising waterproof and water resistant, said shower stall assembly having two or more walls and a floor portion, wherein said two or more walls and said floor portion define a shower cavity and at least one wall of said two or more walls has an integrally formed alignment ridge; and a one-piece bathing tub substantially made from a self-standing material selected from the group comprising waterproof and water resistant, wherein said bathing tub has an alignment edge that is positioned adjacent to said alignment ridge when said bathing tub is installed in said shower cavity and wherein said one-piece bathing tub is removed as a single unit from said shower cavity defined by said shower stall assembly or installed as a single unit in said shower cavity defined by said shower stall assembly with no disassembly of said shower stall assembly.

2. The bathing fixture as claimed in claim 1 wherein said at least one wall is made from a material selected from the group consisting of fiberglass and acrylic.

3. The bathing fixture as claimed in claim 1 further comprising a grab handle positioned adjacent to said at least one wall of said shower stall assembly.

4. The bathing fixture as claimed in claim 1 wherein the floor portion of said shower stall assembly defines a shower drain configured to be connected to a wastewater conduit.

5. The bathing fixture as claimed in claim 1 wherein the bathing tub has a tub body which defines a bathing recess, a tub drain, and an overflow orifice fluidly connected to said bathing recess and said tub drain.

6. The bathing fixture as claimed in claim 5 wherein said tub body further defines a base portion and further comprising a reinforcing plate positioned adjacent to said base portion to help support said base portion of said tub body.

7. The bathing fixture as claimed in claim 5 wherein said floor portion of said shower stall assembly forms a removable riser and said tub body forms a riser receiving orifice for receiving said riser.

8. The bathing fixture as claimed in claim 5 wherein said floor portion defines a shower drain configured to be connected to a wastewater conduit.

9. The bathing fixture as claimed in claim 8 wherein said tub drain is fluidly connected to said shower drain.

10. A method of converting a bathing fixture having a shower stall assembly and a bathing tub, said shower stall assembly and said bathing tub each substantially made from a material selected from the group comprising waterproof and water resistant, said shower stall assembly defines two or more walls and a floor portion which collectively define a shower cavity, a removable riser positioned adjacent to said floor portion to prevent water from spilling from said floor portion of said shower cavity, said bathing tub having a tub body which defines a pre-formed riser receiving orifice configured to receive said removable riser, comprising the step of inserting said removable riser positioned adjacent to said floor portion of said shower stall assembly into said riser receiving orifice defined by said tub body of said bathing tub.

11. The method of converting a bathing fixture as claimed in claim 10 wherein said floor portion defines a shower drain and said bathing tub defines a tub drain, further comprising the step of providing a watertight seal between said shower drain and said tub drain.

12. The method of converting a bathing fixture as claimed in claim 11 further comprising the step of caulking seams formed at intersections of said at least one wall of said shower stall assembly and said tub body.

13. The method of converting a bathroom fixture as claimed in claim 12 further comprising the step of removing said caulk.

14. The method of converting a bathing fixture as claimed in claim 13 further comprising the step of removing the bathing tub from the shower stall cavity such that the removable riser positioned adjacent to said floor portion of said shower stall is removed from the riser receiving orifice defined by said tub body of said bathing tub.

15. The method of converting a bathing fixture as claimed in claim 14 further comprising the step of removing said seal positioned adjacent to said shower drain and said tub drain.

16. A bathing fixture comprising:

a shower stall assembly substantially made from a material selected from the group comprising waterproof and water resistant, said shower stall assembly having two or more walls and a floor portion that define a shower cavity, wherein at least one wall of said two or more walls defines an alignment ridge and said floor portion defines a removable attached riser; and a bathing tub substantially made from a material selected from the group comprising waterproof and water resistant, said bathing tub defines an alignment edge and a riser receiving orifice, wherein said alignment edge of said bathing tub is removably positioned adjacent to said alignment ridge defined by said at least one wall when said bathing tub is removably positioned in the shower cavity and said bathing tub receives a riser receiving orifice when said bathing tub is removably positioned in said shower cavity.

17. The bathing fixture as claimed in claim 16 wherein said shower stall assembly defines a shower drain, said tub body defines a tub drain, and said shower drain and said tub drain are fluidly connected to one another.

* * * * *

UNITED STATES PATENT AND TRADEMARK OFFICE

CERTIFICATE OF CORRECTION

PATENT NO. : 6,625,825 B1
DATED : September 30, 2003
INVENTOR(S) : Groner et al.

It is certified that error appears in the above-identified patent and that said Letters Patent is hereby corrected as shown below:

Title page,
Item [73], Assignee, "GFM" should read -- CFM --.

Signed and Sealed this

Twentieth Day of January, 2004

JON W. DUDAS
*Acting Director of the United States Patent and Trademark Office*